US008303244B2

(12) United States Patent
Alexander et al.

(10) Patent No.: US 8,303,244 B2
(45) Date of Patent: Nov. 6, 2012

(54) ENGINE-MOUNTED FAN SHROUD AND SEAL

(75) Inventors: Joseph H. Alexander, Royal Oak, MI (US); Jeffrey R. Tatrow, Macomb, MI (US); Paul R. Mueller, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1755 days.

(21) Appl. No.: 11/150,864

(22) Filed: Jun. 10, 2005

(65) Prior Publication Data

US 2006/0280598 A1 Dec. 14, 2006

(51) Int. Cl.
*F01D 11/08* (2006.01)

(52) U.S. Cl. ..... 415/119; 415/213.1; 415/173.3; 415/223; 415/228

(58) Field of Classification Search ..... 415/119, 415/211.2, 213.1, 173.1, 173.3, 220, 223, 415/224, 228, 247 R
See application file for complete search history.

(56) References Cited

U.S. PATENT DOCUMENTS

| | | | | | |
|---|---|---|---|---|---|
| 2,668,523 | A | * | 2/1954 | Lamb | 415/220 |
| 3,144,859 | A | * | 8/1964 | Walton | 416/247 R |
| 4,213,426 | A | * | 7/1980 | Longhouse | 415/228 |
| 4,514,140 | A | * | 4/1985 | Knopf | 415/119 |
| 4,522,160 | A | * | 6/1985 | Speers et al. | 415/213.1 |
| 4,566,852 | A | * | 1/1986 | Hauser | 415/220 |
| 4,774,911 | A | * | 10/1988 | Yamaguchi et al. | 415/213.1 |
| 5,183,382 | A | * | 2/1993 | Carroll | 415/173.6 |
| 5,498,130 | A | * | 3/1996 | Wakley et al. | 415/213.1 |
| 5,577,888 | A | * | 11/1996 | Capdevila et al. | 415/210.1 |
| 5,701,854 | A | * | 12/1997 | Hauser | 415/208.1 |
| 6,036,444 | A | * | 3/2000 | Barney et al. | 416/247 R |

* cited by examiner

*Primary Examiner* — Igor Kershteyn

(57) ABSTRACT

The invention concerns an engine-mounted fan shroud for use in a vehicle that has a shroud body supported by a vehicle engine, including an outer ring made of a first material having a first stiffness, and a bodyside seal extending from and being integral with the outer ring, with the bodyside seal being made of a second material having a second stiffness that is less than the first stiffness. The bodyside seal fits into and seals around a seal opening in a body-mounted shroud that is mounted to radiator support structure.

18 Claims, 2 Drawing Sheets

ENGINE-MOUNTED FAN SHROUD AND SEAL

BACKGROUND OF INVENTION

The present invention relates to a vehicle having an engine-mounted fan shroud.

For most automobiles and trucks driven by an internal combustion engine, a cooling fan is located adjacent to heat exchangers in an engine compartment and driven by the engine. This cooling fan ensures enough air flow to prevent overheating. The heat exchangers may be, for example, a radiator and a condenser for an air conditioning system, which are typically mounted, via support structure, to the body of the vehicle. One concern with the airflow pattern generated by the fan is that the air will just recirculate, thus reducing the cooling effectiveness of the fan. As a result, in some vehicles, fan shrouds are employed that encircle the fan close to the heat exchangers.

Since there may be tolerances in the position of the heat exchangers relative to the engine, and the engine and heat exchangers may move somewhat relative to each other during vehicle operation, some fan shroud assemblies have both a body-mounted shroud and an engine-mounted shroud. The body-mounted shroud mounts to and moves with the heat exchanger support structure, which is mounted to the body, and the engine-mounted shroud mounts to and moves with the engine. To ensure the shroud assembly performs its intended function, a seal is located between the engine-mounted fan shroud and the body-mounted shroud that will allow for tolerances and maintain a seal between the two even when they move somewhat relative to each other.

Prior art fan shroud assemblies that include both a body-mounted shroud and an engine-mounted fan shroud have used a sealing arrangement with a metal ring and a bellows seal attached by a worm gear clamp. Other such shroud assemblies have attached a separate seal to a shroud with rivets. Still others have molded a shroud with through-holes in it, and then placed this shroud in a second mold where a seal is molded to the shroud in such a way that the seal material will flow through the holes in the shroud to mechanically secure the seal to the shroud. But all of these require the fabricating and handling of separate components—and some also require additional assembly steps—to create an engine-mounted fan shroud assembly. Thus, all require more process and assembly time than is desirable and may require the fabrication and handling of a greater number of individual parts than is desirable.

SUMMARY OF INVENTION

An embodiment of the present invention contemplates an engine-mounted fan shroud for use in a vehicle. The engine-mounted fan shroud has a shroud body, adapted to be supported by a vehicle engine, including an outer ring made of a first material having a first stiffness, and a bodyside seal extending from and being integral with the outer ring, with the bodyside seal being made of a second material having a second stiffness that is less than the first stiffness.

An embodiment according to the present invention may also contemplate an engine fan shroud assembly for use in a vehicle that includes a body-mounted shroud and an engine-mounted shroud. The body-mounted shroud, adapted to be mounted to a support structure of a vehicle body, includes a generally cylindrical seal opening. The engine-mounted fan shroud, adapted to be supported by a vehicle engine, has a shroud body including an outer ring made of a first material having a first stiffness, and a bodyside seal extending from and being integral with the outer ring and being in sealing surface contact with the seal opening, and with the bodyside seal being made of a second material having a second stiffness that is less than the first stiffness.

An advantage of an embodiment of the present invention is that the engine-mounted fan shroud is formed as an integral part, thus reducing the fabrication and assembly time, and reducing the number of different parts in the overall fan shroud assembly. Only a single mold, employing a two shot process, is required to fabricate this engine-mounted fan shroud, without any post mold processes required to affixed the components to one another.

Another advantage of an embodiment of the present invention is that, while the engine-mounted fan shroud is formed as an integral part, the shroud body and stators are made from a material having the required strength and stiffness properties to maintain their shape during vehicle operation while the bodyside seal is made from a material that is flexible enough to create and maintain a sealing contact with the body-mounted shroud. Thus, the increase in efficiency of the engine driven fan is still maintained by this new integral engine-mounted fan shroud.

DETAILED DESCRIPTION

Figure 1:
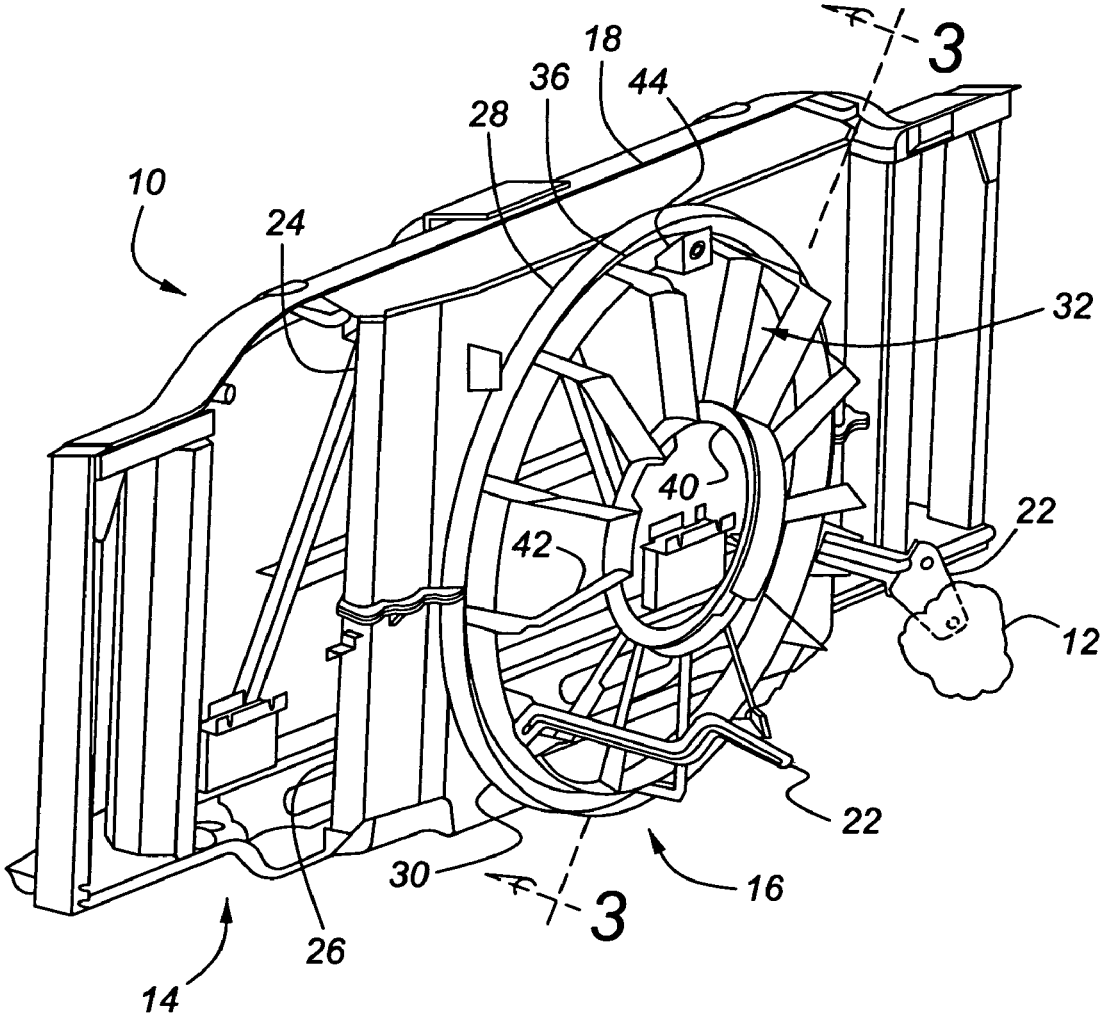
FIG. 1 is a perspective view of a portion of an engine compartment in a vehicle, in accordance with the present invention.
Figure 2:
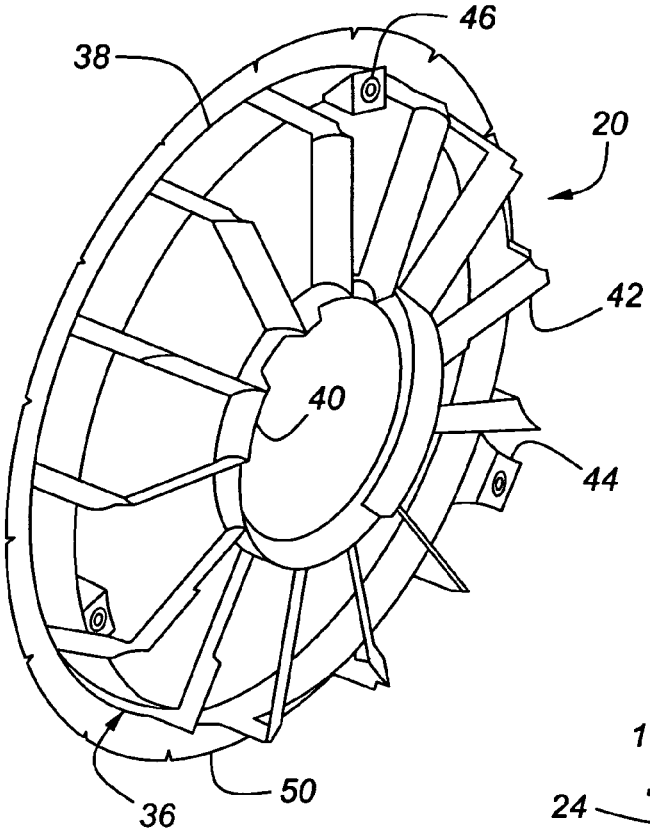
FIG. 2 is a perspective view, on an enlarged scale, of the engine-mounted fan shroud shown in FIG. 1.
Figure 4:
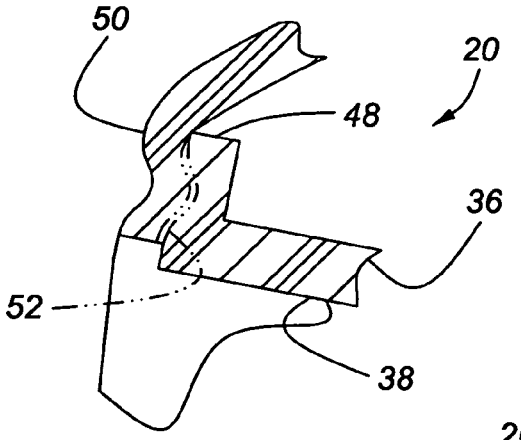
FIG. 4 is a view, on an enlarged scale, of encircled area 4 in FIG. 3.
Figure 3:
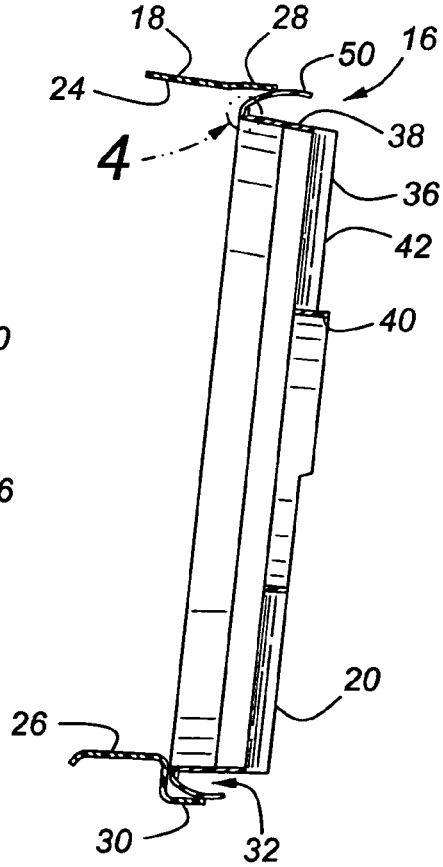
FIG. 3 is a section view, on an enlarged scale, of the engine-mounted fan shroud and body-mounted shroud, taken along line 3-3 in FIG. 1.

FIGS. 1-4 show components in an engine compartment, indicated generally at 10, with a portion of an engine, indicated generally at 12. A radiator (heat exchanger) support structure 14 mounts to the vehicle body (not shown). Heat exchangers (not shown), such as a radiator and condenser, mount to the radiator support structure 14. An engine driven fan (not shown) extends from the engine 12 toward the heat exchangers. The vehicle components discussed so far can be conventional and so will not be discussed further herein.

A fan shroud assembly 16 includes a body-mounted shroud 18, which is mounted to the radiator support structure 14, and an engine-mounted fan shroud 20, which is mounted to the engine 12, preferably to the engine block via three mounting brackets 22 (only two of three shown). The body-mounted shroud 18 has an upper shroud 24 that is connected to a lower shroud 26. The upper and lower shrouds 24, 26 each include a semi-cylindrical fan opening flange 28, 30, respectively, which together define a generally cylindrical seal opening 32.

The engine-mounted fan shroud 20 includes a shroud body 36 that has a generally cylindrical outer ring 38, a generally cylindrical central ring 40, and a set of stators 42 that extend between the outer ring 38 and central ring 40. The central ring 40 defines a opening through which a portion of a fan assembly (not shown) extends. The stators 42 extend generally radially and are blade shaped, with the blades being canted in order to redirect the air flow coming from the fan toward the engine 12. The outer ring 38 includes three mounting bosses 44, which may include optional grommet inserts 46, to which the mounting brackets 22 attach. If the outer ring 38 does include grommet inserts 46, preferably the inserts 46 are molded into the engine-mounted fan shroud 20. The outer ring 38 also includes a lip 48 to which a bodyside seal 50 is molded. The bodyside seal 50 of the engine-mounted fan shroud 20 is generally circular in shape and extends generally radially outward from the outer ring 38 of the shroud body 36.

The bodyside seal 50 needs to easily flex (deform elastically) to conform to and seal against the contours of the seal opening 32, while the shroud body 36 needs to be strong enough to be able to retain its shape so it can support the bodyside seal 50 and for the stators 42 to be stiff enough to perform their function of redirecting air flow. Accordingly, the bodyside seal 50 is made from a relatively soft, pliable (less stiff) material—for example, a thermoplastic elastomer type of material such as Santoprene® (made by ExonMobile Chemical)—while the shroud body 36 is made from a relatively strong and hard (stiff) material—for example, nylon or a similar type of hard plastic.

Despite the fact that the two different portions of the engine-mounted fan shroud 20 are made from different materials, they are formed as an integral part by a sequential, two-shot injection molding process where both portions are shot in same mold (not shown). The nylon is injected into the mold to create the shroud body 36 and then the Santoprene® is injected into the same mold to create the bodyside seal 50—creating a single part through chemical fusion at an intersection 52 of the shroud body 36 and the bodyside seal 50. Consequently, the bodyside seal 50 and shroud body 36 are integral. The term "integral" as used herein means a part with portions thereof chemically fused together for a permanent attachment that forms a single, monolithic piece—not two separate pieces that are later mated or secured together with adhesive, or fasteners or some other means of mechanical attachment of separate pieces.

Since the engine-mounted fan shroud 20 is formed as an integral piece in a single mold, there is no post molding assembly of components needed to complete it. During vehicle assembly, the body-mounted shroud 18 is fastened to the radiator support structure 14, and the engine-mounted fan shroud 20 is inserted into the seal opening 32, causing the bodyside seal 50 to elastically flex and partially fold back on itself (that is, extending more in an axial direction rather than in the radial direction it extends when in its unflexed position). This flexing will cause the bodyside seal 50 to bias itself against the seal opening 32, thus sealing between the body-mounted shroud 18 and the engine-mounted fan shroud 20. The mounting brackets 22 are secured between the engine 12 and engine-mounted fan shroud 20 to hold it in place.

During vehicle operation, the engine-mounted shroud 20, being mounted to the engine 12, moves with the engine 12. The body-mounted shroud 18, being mounted to the radiator support structure 14, which is mounted to the body (not shown), moves with the body. As a consequence, the engine-mounted fan shroud 20 will move relative to the body-mounted shroud 18. As they move relative to each other, the bodyside seal 50 will slide relative to the seal opening 32 in the body-mounted shroud 18. But due to its being elastically flexed and held in the seal opening 32, it will slide and bend while staying in contact with this opening 32. Thus, the seal between the two parts of the fan shroud assembly 16 is maintained, which prevents the air flow driven by the fan from recirculating by flowing between the body-mounted shroud 18 and the engine-mounted fan shroud 20.

While certain embodiments of the present invention have been described in detail, those familiar with the art to which this invention relates will recognize various alternative designs and embodiments for practicing the invention as defined by the following claims.

What is claimed is:

1. An engine mounted fan shroud for use in a vehicle comprising:

a shroud body, adapted to be supported by a vehicle engine, including an outer ring made of a first material having a first stiffness; and a bodyside seal extending from and being integral with the outer ring, with the bodyside seal being made of a second material having a second stiffness that is less than the first stiffness.

2. The engine mounted fan shroud of claim 1 wherein the bodyside seal is made of a thermoplastic elastomer.

3. The engine mounted fan shroud of claim 2 wherein the shroud body is made of nylon.

4. The engine mounted fan shroud of claim 1 wherein the shroud body includes a plurality of generally radially extending stators adapted to redirect air flowing thereacross.

5. The engine mounted fan shroud of claim 4 wherein the shroud body includes a central ring affixed to radially inner ends of each of the stators.

6. The engine mounted fan shroud of claim 1 wherein the shroud body further includes a plurality of mounting bosses extending therefrom.

7. The engine mounted fan shroud of claim 6 wherein each of the mounting bosses includes a grommet insert molded therein.

8. The engine mounted fan shroud of claim 1 wherein the outer ring includes a lip to which the integral bodyside seal is fused.

9. An engine fan shroud assembly for use in a vehicle comprising:

a body mounted shroud, adapted to be mounted to a support structure of a vehicle body, including a generally cylindrical seal opening; and an engine mounted fan shroud, adapted to be supported by a vehicle engine, having a shroud body including an outer ring made of a first material and having a first stiffness, and a bodyside seal extending from and being integral with the outer ring and being in sealing surface contact with the seal opening, and with the bodyside seal being made of a second material having a second stiffness that is less than the first stiffness.

10. The engine fan shroud assembly of claim 9 wherein the bodyside seal is made of a thermoplastic elastomer.

11. The engine fan shroud assembly of claim 10 wherein the shroud body is made of nylon.

12. The engine fan shroud assembly of claim 9 wherein the shroud body includes a plurality of generally radially extending stators adapted to redirect air flowing thereacross.

13. The engine fan shroud assembly of claim 12 wherein the shroud body includes a central ring affixed to radially inner ends of each of the stators.

14. The engine fan shroud assembly of claim 9 wherein the outer ring includes a lip to which the integral bodyside seal is fused.

15. The engine fan shroud assembly of claim 9 wherein the shroud body includes a plurality of mounting bosses extending therefrom, and the engine fan shroud assembly includes a plurality of brackets each secured to one of the mounting bosses and adapted to mount to the vehicle engine.

16. The engine fan shroud assembly of claim 9 wherein the body mounted shroud has an upper shroud portion and a lower shroud portion mounted to the upper shroud portion.

17. An engine mounted fan shroud for use in a vehicle comprising:

a shroud body, adapted to be supported by a vehicle engine, including an outer ring, a central ring, and a plurality of generally radially oriented stators extending between the outer ring and the central ring and adapted to redirect air flowing thereacross, with the outer ring including a lip extending therefrom, and wherein the shroud body is made of a first material having a first stiffness; and a bodyside seal extending from and being integral with the lip, with the bodyside seal being made of a second material having a second stiffness that is less than the first stiffness.

18. The engine mounted fan shroud of claim 17 wherein the bodyside seal is made of a thermoplastic elastomer.

* * * * *